United States Patent [19]

Goineau

[11] Patent Number: 4,852,226

[45] Date of Patent: Aug. 1, 1989

[54] COMPOSITE YARN TEXTURING SYSTEM

[75] Inventor: Andre M. Goineau, Spartanburg, S.C.

[73] Assignee: Milliken Research Corporation, Spartanburg, S.C.

[21] Appl. No.: 161,584

[22] Filed: Feb. 29, 1988

[51] Int. Cl.[4] ..... D02G 1/16; D02J 1/12; D02J 3/02

[52] U.S. Cl. ..... 28/220; 28/219

[58] Field of Search ..... 28/219, 220

[56] References Cited

U.S. PATENT DOCUMENTS 4,497,099 2/1985 Scott ..... 28/220
4,501,046 2/1985 Krenzer .
4,610,131 9/1986 Eschenbach et al. ..... 28/220 X
4,674,273 6/1987 Clements et al. ..... 28/220 X

FOREIGN PATENT DOCUMENTS 77685 2/1962 France ..... 28/219

*Primary Examiner*—Robert R. Mackey
*Attorney, Agent, or Firm*—Earle R. Marden; H. William Petry

[57] ABSTRACT

An apparatus and process to produce a spun-like synthetic yarn which employs a filament loop breaker which is periodically and automatically opened to break the vacuum pressure to allow lint collected therein to be released and collected.

3 Claims, 2 Drawing Sheets

COMPOSITE YARN TEXTURING SYSTEM

This invention relates to a yarn texturing process in which an effect yarn forms loops around a core yarn and the loops are broken by a suitable loop breaking device to provide a synthetic yarn with a spun-like yarn appearance.

It is an object of the invention to provide a process and apparatus to provide a spun-like synthetic yarn in which the filament loop breaker is automatically and periodically cleaned of accumulated lint.

Other objects and advantages of the invention will become readily apparent as the specification proceeds to describe the invention with reference to the accompanying drawings, in which.

Figure 1:
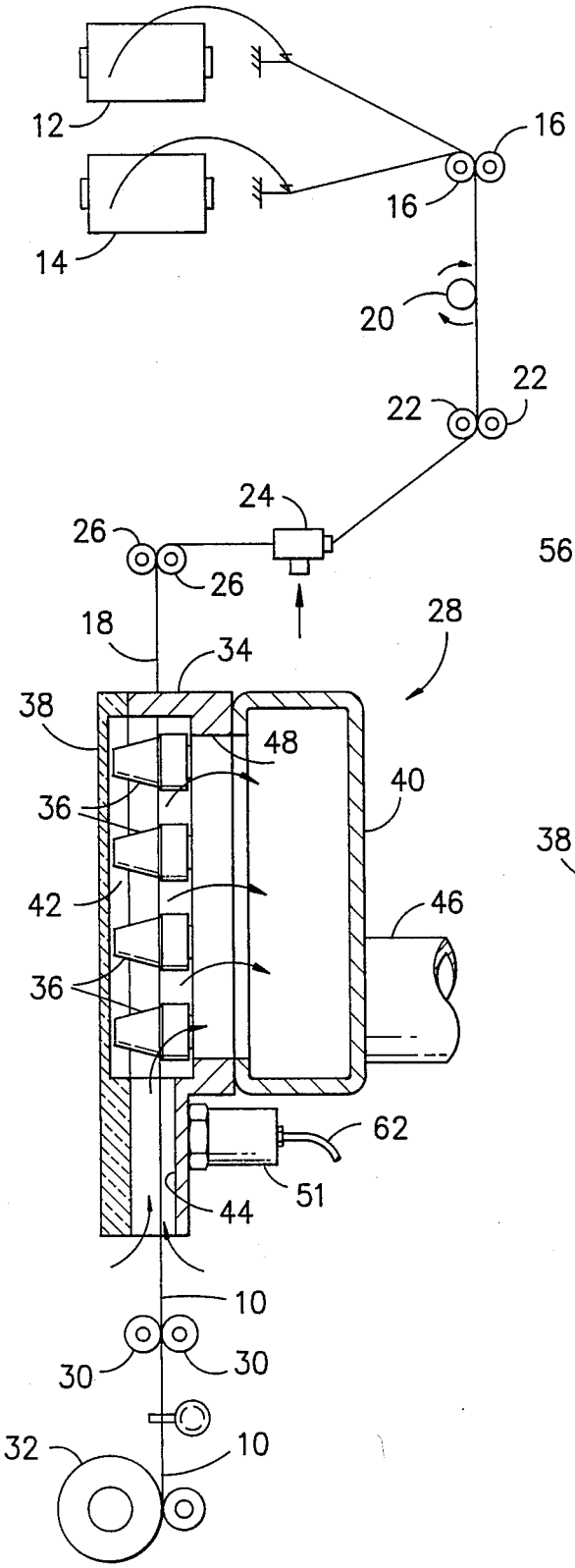
FIG. 1 is a schematic drawing of the process to manufacture a spun-like synthetic yarn.

Looking now to FIG. 1, the overall system is shown to produce a spun-like synthetic yarn 10. The starting yarns are 115/47 continuous filament polyester yarns from packages 12 and 14 which are merged in the nip of rolls 16. The yarn 18 exits the nip of rolls 16 at a speed of 276 meters/minute and is wrapped around the hot pin 20 prior to being drawn by the rolls 22 delivering yarn at a rate of 469 meters/minute. The hot pin 20 is, preferably, maintained at a temperature of about 150° C.

The drawn yarn 18 is then supplied to an air texturing jet 24 supplied with air at a pressure of about 150 p.s.i. wherein, due to the lower speed of the rolls 26 of 344 meters, one of the yarns of the merged yarn 18 wraps around the other of the yarns and is formed into a series of loops. The air textured yarn 18 is then supplied from the rolls 26 through the filament loop breaker 28 to the rolls 30. The spun-like synthetic yarn 10 is then supplied from the rolls 30 at a speed of 400 meters/minute to the take-up package 32 taking up yarn at a rate of 383 meters/minute.

The filament loop breaker 28 basically is a commercially available unit, such as used by BARMAG in the FK6T-80 high speed air texturing machine and shown in Barmag FK6T-80 bulletin Tex 45/2. and consists of housing 34 having a plurality of rolls 36 therein around which the yarn 18 is wrapped, a door 38 to provide access to the rolls 36 for threadup and a vacuum source 40 to suck yarn and lint from the chamber 42 created by the breaking of the loops of the air textured yarn 18. The yarn exists through the channel 44 to the rolls 30.

Figure 2:
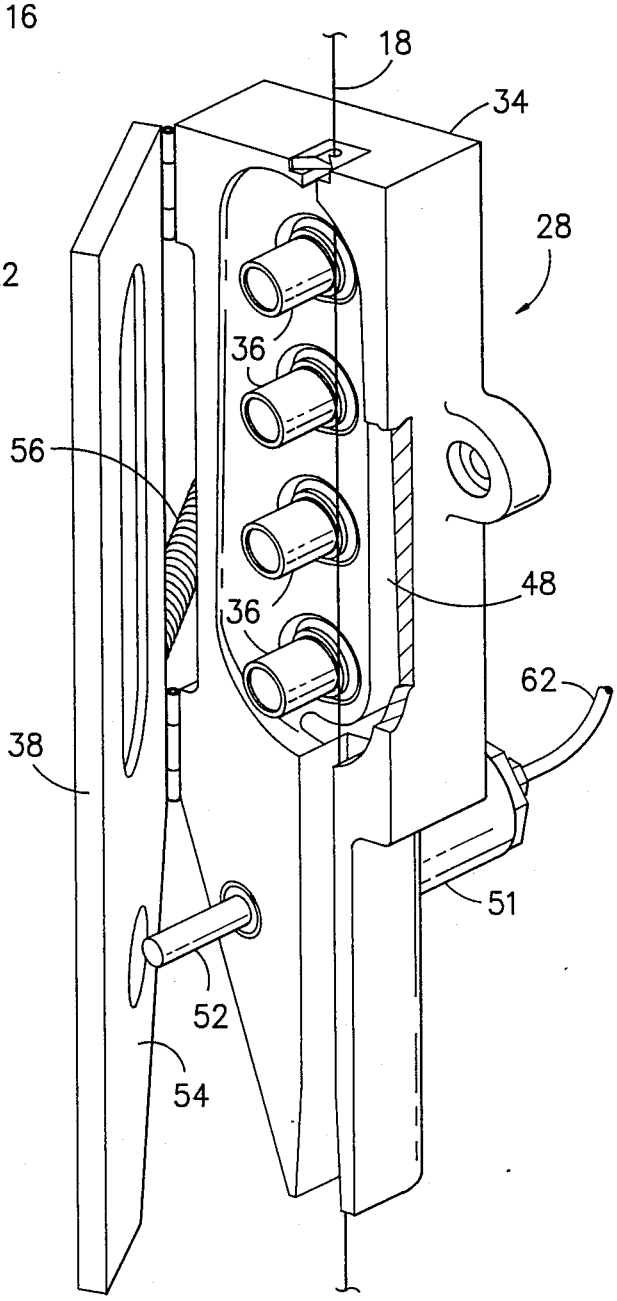
FIG. 2 is a blow-up schematic view of the filament loop breeker shown in FIG. 1.

It should be understood that FIGS. 1 and 2 represent only one position of a multiposition machine and the vacuum source 40 extends the length of the machine and is connected to a source of vacuum pressure through conduit 46 and collects lint through the slots 48 at each position.

In operation, it has been found that a lot of lint, rather than being pulled through the slot 48, tends to adhere to the rolls 36 and the inner surface of the housing 34 in the chamber 42. To alleviate this situation, a solenoid actuated air cylinder 51 has been mounted on the back of each unit 28 with its piston rod 52 projecting into and against the inner surface 54 of the door 38. Periodically the air cylinder 51 is pulsed to force the piston rod 52 outward so that it contacts the door surface 54 to open the door 38 against the action of the spring 56. Opening of the door 38 breaks the vacuum in the chamber 42 allowing the accumulated lint to fall from the surface adhered to and either fall through the channel 44 and/or be pulled through the slot 48 when the door 38 has been released by the piston rod 52. This periodic and automatic opening and closing of the door 38 prevents the accumulation of lint, etc. in the vacuum and loop breaking chamber 42.

Figure 3:
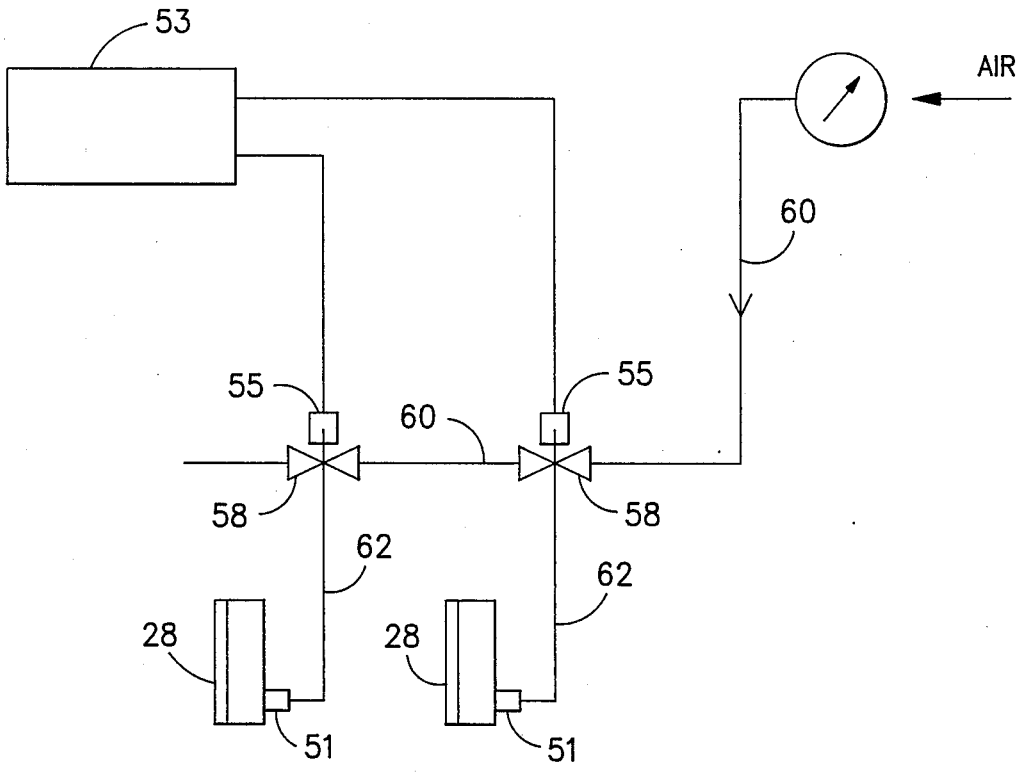
FIG. 3 is a simple schematic view of the control circuit for the automatic door opener of the filament loop breaker.

FIG. 3 schematically represents a simple control diagram showing that a programmable controller 53 is connected to a series of solenoids 55 to periodically, as programmed, activate the three-way valves 58 to supply air from the high pressure air line 60 into the conduit 62 to the desired air cylinder 51. The sequence and number of openings and closings of the doors 38 depends on the program of the computer 53.

It can be seen that the herein-disclosed filament loop breaker has been provided wih an improvement which will automatically and periodically allow accumulated lint therein to be dissipated so that the loop breaker does not clog up and such lint, etc. does not end in the yarn 10 causing unwanted defects and/or effects therein.

Although the preferred embodiment has been described specifically, it is contemplated that changes may be made without departing from the scope or spirit of the invention and it is desired that the invention be limited only by the scope of the claims.

I claim:

1. A system to provide a spun-like yarn from a plurality of synthetic filament yarns comprising: a first means to draw and texturize a plurality of filament yarns which causes at least one yarn to form loops, a second means operably associated with said first means to break the loops formed by said first means and a third means to take up the yarn with the broken loops therein, said second means including a housing with a door thereon, means applying a suction pressure inside said housing, a plurality of rolls in said housing and an opening means to periodically open the door of said housing to break the vacuum therein.

2. The system of claim 1 wherein said opening means includes a plunger, an air cylinder in operative relationship with said plunger and control means to periodically supply air to said cylinder to cause said plunger to open said door.

3. The system of claim 2 wherein said system includes a spring means to bias said door to the closed position and said plunger acts against the bias of said spring means to open said door.

* * * * *